US006557630B2

(12) United States Patent
Harkins et al.

(10) Patent No.: US 6,557,630 B2
(45) Date of Patent: May 6, 2003

(54) METHOD AND APPARATUS FOR DETERMINING THE TEMPERATURE OF SUBTERRANEAN WELLS USING FIBER OPTIC CABLE

(75) Inventors: Gary O. Harkins, Bakersfield, CA (US); Christian Koeniger, Golden Common (GB)

(73) Assignee: Sensor Highway Limited, Southampton (GB)

( * ) Notice: Subject to any disclaimer, the term of this patent is extended or adjusted under 35 U.S.C. 154(b) by 0 days.

(21) Appl. No.: 10/064,891

(22) Filed: Aug. 27, 2002

(65) Prior Publication Data

US 2003/0042019 A1 Mar. 6, 2003

Related U.S. Application Data

(60) Provisional application No. 60/315,658, filed on Aug. 29, 2001.

(51) Int. Cl.[7] ..... E21B 47/06; E21B 19/08

(52) U.S. Cl. ..... 166/250.01; 166/66; 166/70; 166/77.1; 166/385

(58) Field of Search ..... 166/77.1, 384, 166/385, 250.01, 66, 70, 379; 73/152.12, 152.18, 152.54

(56) References Cited

U.S. PATENT DOCUMENTS

| | | | | |
|---|---|---|---|---|
| 2,677,427 A | * | 5/1954 | McKinney et al. | 166/77.1 |
| RE24,086 E | | 11/1955 | Summers | 166/77.1 |
| 2,899,633 A | | 8/1959 | Smith et al. | 324/347 |
| 2,943,682 A | | 7/1960 | Ingram, Jr. et al. | 166/77.1 |
| 3,517,736 A | | 6/1970 | Waldron | 166/351 |
| 3,866,679 A | | 2/1975 | Laky | 166/77 |
| 3,874,232 A | * | 4/1975 | Hardison | 73/154 |
| 4,091,867 A | | 5/1978 | Shannon, Jr. et al. | 166/77.3 |
| 4,189,705 A | | 2/1980 | Pitts, Jr. | |
| 4,192,380 A | | 3/1980 | Smith | 166/245.2 |
| 4,389,645 A | | 6/1983 | Wharton | |
| 4,515,211 A | | 5/1985 | Reed et al. | 166/77.1 |
| 4,547,774 A | | 10/1985 | Gould | |
| 4,577,693 A | | 3/1986 | Graser | 166/338 |
| 4,705,353 A | | 11/1987 | Wagoner | |
| 4,832,121 A | * | 5/1989 | Anderson | 166/250.09 |
| 4,915,178 A | | 4/1990 | Goldschild | 166/385 |
| 5,111,880 A | | 5/1992 | Wittrisch et al. | 166/385 |
| 5,122,209 A | | 6/1992 | Moore et al. | |
| 5,140,319 A | | 8/1992 | Riordan | |

(List continued on next page.)

FOREIGN PATENT DOCUMENTS

| | | |
|---|---|---|
| WO | WO 96/41066 | 12/1996 |
| WO | WO 99/48111 | 9/1999 |
| WO | WO 01/20129 | 3/2001 |
| WO | WO 02/06631 | 1/2002 |

OTHER PUBLICATIONS

*Method and Apparatus for Determining the Temperature of Subterranean Wells Using Fiber Optic Cable*, Description of invention, pp 1–24.

*Method and Apparatus for Logging a Well Using Fiber Optics*, Background Information and drawings of invention, pp 1–23.

*Primary Examiner*—Hoang Dang

(74) *Attorney, Agent, or Firm*—Lundeen & Dickinson, L.L.P.; David B. Dickinson; H. Lee Huddleston, Jr.

(57) ABSTRACT

Methods and apparatuses to determine the temperature profile of a wellbore using a fiber optic cable and an anchor are disclosed. Furthermore, a pressurized wellhead spool that couples to a standard Christmas tree structure on a well head to facilitate the injection of fiber optic cable into an oil and gas well is disclosed. The wellhead spool is portable and may be connected to fiber optic cable already located at the site, for quick connection to on-site instrumentation. A method of using the apparatuses disclosed to measure wellbore temperature at multiple depths of investigation is also disclosed.

55 Claims, 5 Drawing Sheets

U.S. PATENT DOCUMENTS 5,184,682 A 2/1993 Delacour et al.
5,275,038 A 1/1994 Sizer et al.
5,355,128 A 10/1994 Riordan
5,435,351 A * 7/1995 Head ..... 138/111
5,441,110 A * 8/1995 Scott, III ..... 166/308
5,493,626 A 2/1996 Schultz et al.
5,495,547 A 2/1996 Rafie et al.
5,495,755 A 3/1996 Moore
5,581,024 A 12/1996 Meyer, Jr. et al.
5,894,104 A 4/1999 Hedberg
5,896,939 A 4/1999 Witte
5,988,286 A * 11/1999 Dwiggins ..... 166/382
6,004,639 A * 12/1999 Quigley et al. ..... 428/36.3
6,060,662 A 5/2000 Rafie et al.
6,072,567 A 6/2000 Sapack
6,082,454 A 7/2000 Tubel ..... 166/250.15
6,100,696 A 8/2000 Sinclair
6,137,621 A 10/2000 Wu
6,151,961 A 11/2000 Huber et al.
6,170,570 B1 1/2001 Aguesse et al. ..... 166/65.1
6,268,911 B1 * 7/2001 Tubel et al. ..... 356/72
6,272,434 B1 8/2001 Wisler et al.
6,281,489 B1 * 8/2001 Tubel et al. ..... 250/227.14
6,333,699 B1 12/2001 Zierolf
6,351,245 B1 2/2002 Amini
6,359,569 B2 3/2002 Beck et al.
6,378,627 B1 4/2002 Tubel et al. ..... 175/24
6,446,723 B1 * 9/2002 Ramos et al. ..... 166/285
2001/0043146 A1 11/2001 Beck et al.
2001/0054969 A1 12/2001 Thomeer et al.
2002/0007945 A1 1/2002 Neuroth et al.
2002/0027004 A1 * 3/2002 Bussear et al. ..... 166/250.15
2002/0032529 A1 3/2002 Duhon
2002/0050930 A1 5/2002 Thomeer et al.

* cited by examiner

METHOD AND APPARATUS FOR DETERMINING THE TEMPERATURE OF SUBTERRANEAN WELLS USING FIBER OPTIC CABLE

CROSS REFERENCE TO RELATED APPLICATIONS

This application claims the benefit of provisional application U.S. Ser. No. 60/315,658 filed Aug. 29, 2001.

BACKGROUND OF INVENTION

This invention generally relates to oil and gas well logging and, more particularly, to an apparatus and method for deploying fiber optic cabling and profiling the temperature of the well using the fiber optic cable.

Oil and gas exploration is a risky, complex task that involves sophisticated equipment and substantial financial resources. Whether on land or at sea, a search for oil and gas commences with the drilling of a well. A well may reach a depth of over a mile, or, in the case of ultraheavy rigs, may reach more than six miles in depth.

Once a well is drilled, a technique known as well logging (or wireline logging) provides valuable information about the well, specifically about the likely presence of hydrocarbons nearby. Traditionally, wireline logging was performed by lowering a measuring device known as a sonde down the well. A sonde is a metal container, usually a cylinder, which contains various instrumentation used to gather data.

The wireline sonde is lowered to the bottom of the well, at the well bore. Measurements are taken by the sonde as it is being lifted back to the surface of the well. The types of measurements taken may vary widely. Examples of measurements that may be performed include natural radiation emission, reaction to gamma ray or neutron bombardment, sonic, electrical, electromagnetic induction, resistivity, and so on.

With multiple instruments contained within, the sonde is typically heavy enough to be dropped down the well on a cable or wire. The sonde may be pulled back to the surface using a wench or a pulley.

Recently, fiber optic cable has been used as an alternative for obtaining valuable well data. Fiber optic cable may be advantageous because data can be transmitted at a high speed over long distances. Fiber optic cable is non-conductive and thus may be preferable to use in the well over electrical or electromechanical instruments because of the presence of explosive hydrocarbons.

Better yet, the measurements obtained using the fiber optic cable may be immediately transmitted up the well to a receiving system, such as a portable computer. Using techniques such as optical time domain reflectometry (OTDR), fiber optic cables have, in many cases, supplanted traditional mechanisms for obtaining data within the well bore. Transmitting fiber optic cable down a well under pressure, however, may be problematic.

Thus, there is a need for a method of delivering fiber optic cable down a well under pressure.

SUMMARY OF INVENTION

In accordance with the embodiments described herein, a wellhead spool is disclosed comprising a connection to a well head, a sealed spool for storing fiber optic cable to be disposed down a well bore, and an anchor coupled to the fiber optic cable, wherein the anchor is placed in an opening of the well head and the fiber optic cable is released from the spool. In one embodiment, the wellhead spool comprises a motor, preferably hydraulic, coupled to the spool to both release the fiber optic cable from and to return the fiber optic cable to the spool. In a second embodiment, the wellhead spool comprises a solvent dispersal tube to clean the fiber optic cable upon return to the spool. In a third embodiment, the wellhead spool comprises a safety valve for equalizing the pressure between the wellhead spool and the well bore.

In another aspect of the invention, a method is disclosed comprising mounting a wellhead spool providing a fiber optic cable in a sealable housing, coupling the fiber optic cable to an anchor, engaging the sealable housing to a well head, opening a valve to the well bore, deploying the anchor and fiber optic cable into the well bore, and coupling the fiber optic cable to a measuring instrument. The method further discloses dispersing a solvent upon the fiber optic cable and engaging the anchor to a wall of the well bore.

Furthermore, in another aspect of the invention, a method and apparatus to profile the temperature of a wellbore using a fiber optic cable and an anchor is disclosed. Particularly, the apparatus and method include mounting an anchor to a fiber optic cable and deploying the combination downhole to anchor and take measurements at desired depths of investigation. More specifically, a method for measuring the temperature of a wellbore at multiple depths of investigation using a fiber optic cable and an anchor is disclosed.

DETAILED DESCRIPTION

In accordance with the embodiments described herein, a wellhead spool may be employed to facilitate the injection of fiber optic or other cable into an oil and gas well. The wellhead spool is portable and may be connected to fiber optic cable already located at the site, for quick connection to on-site instrumentation. As the fiber optic cable is spooled and unspooled, crimping of the cable and other effects known to occur when cable is wrapped around an object, is avoided The wellhead spool may be used in a well under pressure, whether on land or in sub-sea exploration operations, and may operate with a wireline anchor to gravity-feed the fiber optic cable, if needed. The wellhead spool couples to a standard Christmas tree structure for practical operation by oilfield employees.

Figure 1:
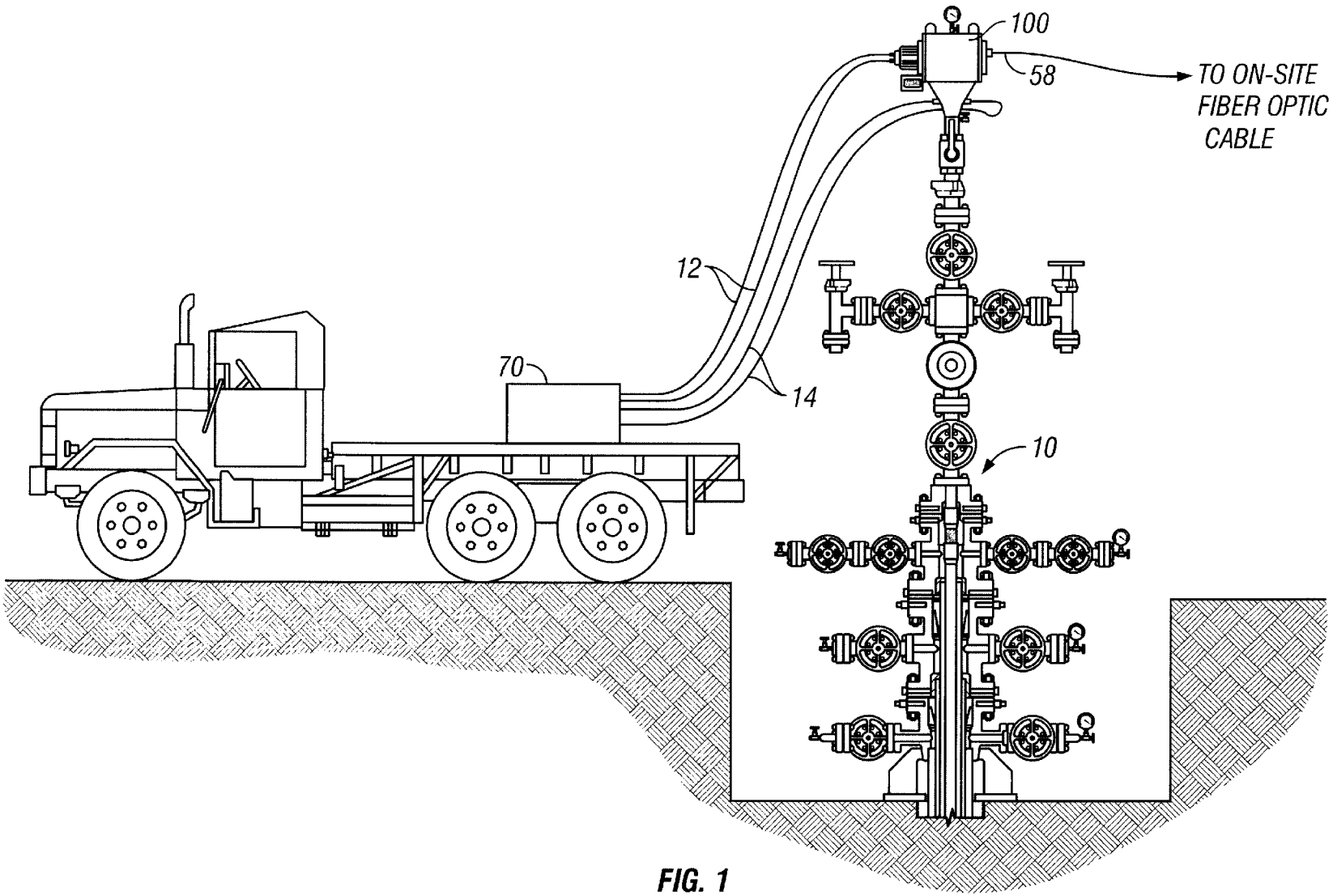
FIG. 1 is a diagram of a wellhead spool in an operative position according to a preferred embodiment of the invention.

A wellhead spool 100, coupled to a typical Christmas tree structure 10, is depicted in FIG. 1, according to one embodiment. Extending from the wellhead spool 100 are hydraulic lines 12, wash feed lines 14, and a cable feed 58. The hydraulic lines 12 and the wash feed lines 14 are coupled to a portable hydraulic pump 70 that may be situated on a vehicle, as shown. Alternatively, the lines 12 and 14 may be connected to an on-site pump, to a portable electric generator or to a different electrical power source (not shown), if available.

The cable feed 58 may be coupled to an optical time domain reflectometer (OTDR) analyzer, such as is offered by Sensa as a distributed temperature sensing (DTS) device, or to on-site fiber optic cable (not shown). The on-site fiber optic cable may already be connected to the OTDR analyzer or other instrumentation such as a laptop computer, in preparation for performing well measurements. The wellhead spool 100 conveniently provides the link between the instrumentation and the well, as described further below.

Alternatively, the wellhead spool 100 may be maintained at the site and used, as needed, to obtain well information such as temperature, resistivity, chemical characteristic of the sub-surface structure, and so on. Additional valves and/or pipes, not shown in FIG. 1, may be coupled between the wellhead spool and the remainder of the Christmas tree structure 10, as is the normal practice in well maintenance.

Figure 2:
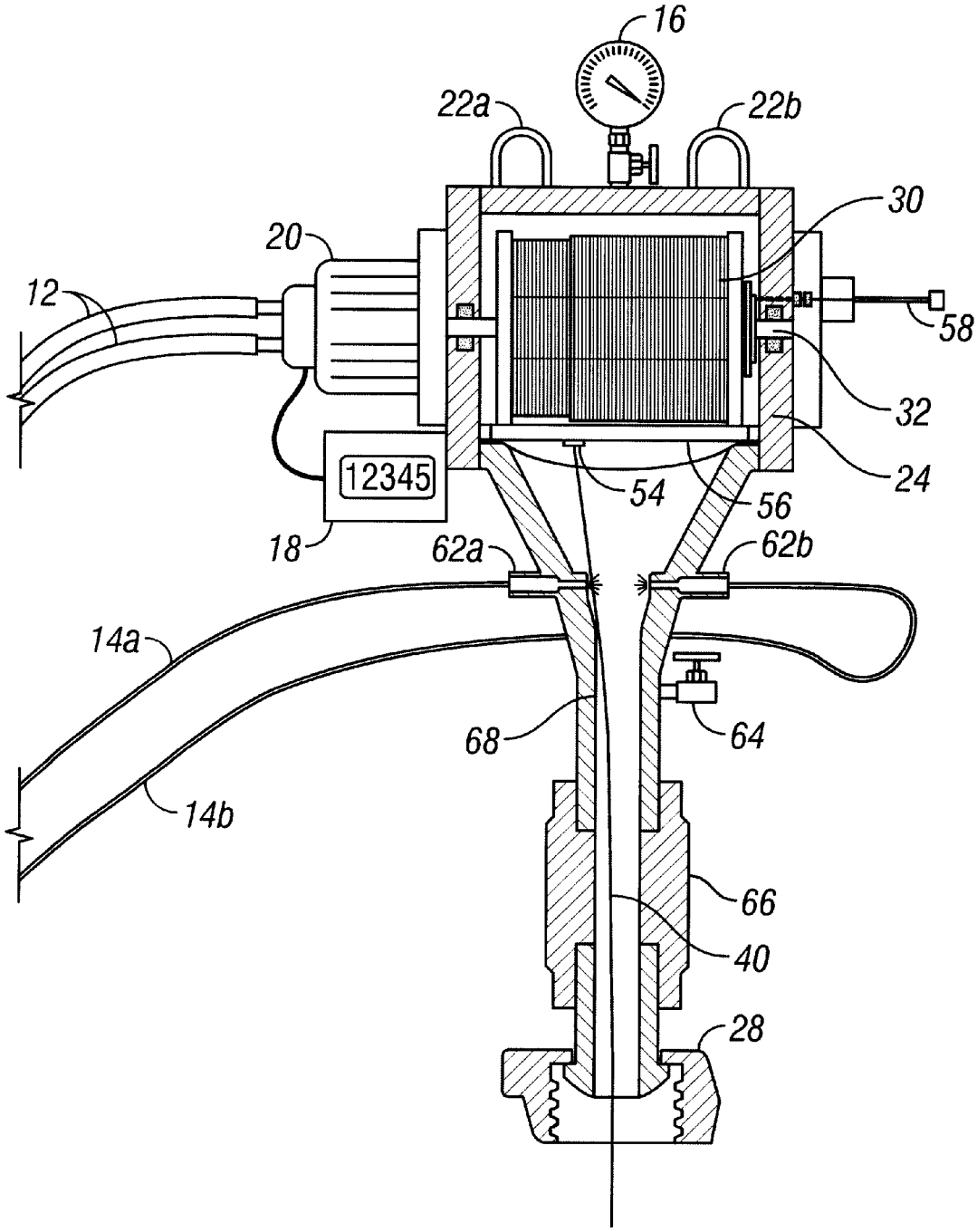
FIG. 2 is an inside view of the wellhead spool of FIG. 1 according to one embodiment of the invention.

In FIG. 2, a more detailed view of the wellhead spool is depicted, according to one embodiment. The wellhead spool 100 includes spool housing 24, inside which a spool 30 of fiber optic cable 40 is maintained. The spool 30 rotates around an axle 32 which is operated by a motor 20, which may be a hydraulic motor . The spool housing 24 further includes a spool guide 54 coupled to a spool guide track 56. The spool guide 54 moves freely along the spool guide track 56 to steer the fiber optic cable to and from the spool 30. Although depicted below the spool 30 in FIG. 2, the spool guide 54 and track 56 may be positioned above the spool, in another embodiment. The fiber optic cable 40 may be held by a centralizing apparatus such as a ring, a guide, or by other methods well-known to those of skill in the art.

The hydraulic motor 20 is coupled to the hydraulic lines 12, through which hydraulic fluid is transported. The hydraulic pump 70 (see FIG. 1) feeds the hydraulic fluid, typically an oil-based liquid, which then causes the hydraulic motor 20 to rotate, and, thus, the axle 32 and spool 30 to turn. Alternatively, an electric motor can be used to supply power to the wellhead spool 100.

In one embodiment, a counter 18 is connected to the hydraulic motor. The counter 18 may tally the number of rotations, the length of the fiber optic cable disposed, and so on. This allows oil field workers to reasonably ascertain the position of the fiber optic cable 40 as it is disposed down the well bore.

The wellhead spool 100 further includes a pressure gauge 16, disposed upon the top of the spool housing 24, in one embodiment. Upon engagement, the wellhead spool becomes part of the wellhead. Accordingly, the contents therein may be under high pressure. The pressure gauge 16 is a standard device for monitoring the physical condition of the well bore. On either side of the pressure gauge, a pair of lift eyes 22 are coupled to the spool housing 24, for handling of the spool 100.

The wellhead spool 100 is coupled to the Christmas tree 10 or other wellhead structure by a quick-connect flange 28, in one embodiment. In one embodiment, the quick-connect flange 28 is a type of threaded hammer union device, known to those of skill in the art. The quick-connect flange 28 is one of a number of devices, known to those familiar with oilfield exploration and maintenance, that may be used to connect the wellhead spool 100 to the Christmas tree 10.

Figure 3:
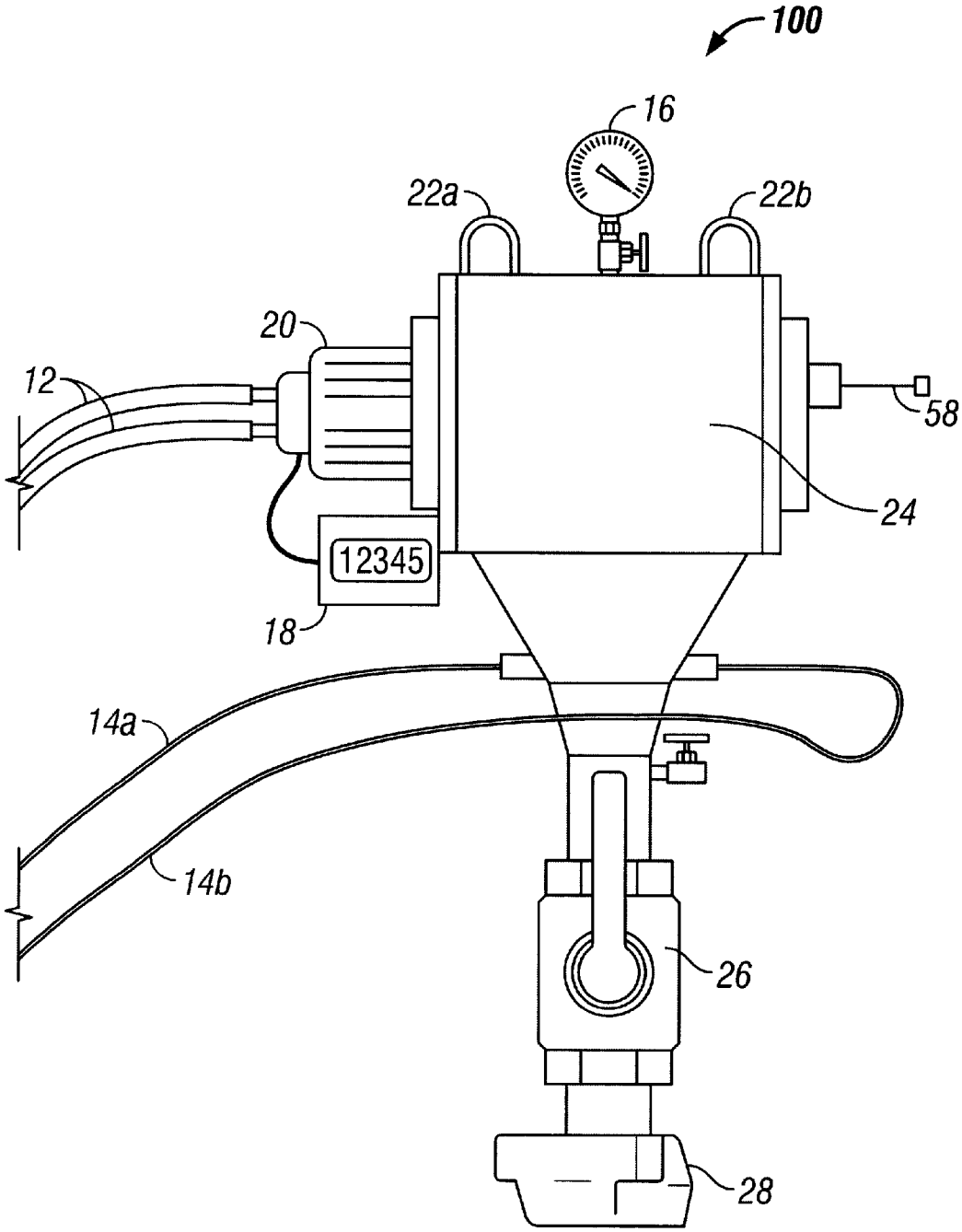
FIG. 3 is a diagram of the outside of the wellhead spool of FIG. 1 according to one embodiment of the invention.

Above the quick-connect flange 28 is a safety valve housing 66 for supporting a safety valve 26, as shown in FIG. 3. Until the safety valve 26 is opened, the fiber optic cable 40 is not sent down the wellhead. Further, in one embodiment, the safety valve 26 is used to balance the pressure from the well following installation or to prevent a high-pressure incident during removal of the wellhead spool from the well.

Extending downward in a cylindrical, then tubular arrangement, a fiber optic feed tube 68 receives the fiber optic cable 40. Upon engagement of the wellhead spool 100 with the Christmas tree 10, the fiber optic feed tube 68 forms a continuous cavity with a similar cavity in the Christmas tree 10 and, ultimately, with the well bore. The continuous cavity is the conduit through which the fiber optic cable 40 is fed down, and then back up, the well bore.

Installation of the wellhead spool 100 may occur while the well is under high pressure. The fiber optic feed tube 68 cavity fills with gas under high pressure during installation. The safety valve 26 may be adjusted to equalize the pressure between the well bore and the feed tube 68. Further, in one embodiment, a bleed valve 64 is used with safety valve 26 to adjust the pressure in the wellhead spool.

The wellhead spool 100 is installed in a manner familiar to those of ordinary skill in the art. For example, to install the wellhead spool 100, a valve in the Christmas tree 10 is closed such that hydrocarbons are not released from the top of the Christmas tree 10. Then, the wellhead spool 100 is coupled to the Christmas tree with the safety valve 26 closed, according to one embodiment. Once the wellhead spool is successfully engaged with the Christmas tree, the valve of the Christmas tree 10, then the safety valve 26, are opened, allowing hydrocarbons to flow from the well bore up to the fiber optic feed tube 68.

To remove the wellhead spool 100, in one embodiment, the safety valve 26 is first closed, separating the cavity of the wellhead spool from the well bore cavity. Also, the valve of the Christmas tree is closed, in one embodiment. Prior to removing the wellhead spool, to release pressure within the fiber optic feed tube 68, the bleed valve 64 is opened, releasing pressure from the wellhead spool. The wellhead spool may then be removed safely.

Once pressure is balanced between the spool body and the well bore, the feed tube and the well bore are maintained at the same pressure, in one embodiment. Further, there is no resistance of a type typically encountered when trying to inject a line from a low pressure orifice into a high pressure stream.

In one embodiment, the wellhead spool 100 includes a mechanism for cleaning the fiber optic cable 40 as it is being returned to the spool 30. The wash feed lines 14 that are coupled to the hydraulic pump 70 (see FIG. 1) transport solvent into the wellhead spool through a pair of solvent dispersal tubes (62). A first wash feed line 14*a* is coupled to a left solvent dispersal tube 62*a*; a second wash feed line 14*b* is coupled to a right solvent dispersal tube 62*b*, as depicted in FIGS. 2 and 3.

In FIG. 2, the left solvent dispersal tube 62*a* directs the solvent toward the fiber optic cable 40 from the left; simultaneously the right solvent dispersal tube 62*b* directs the solvent toward the fiber optic cable 40 from the right. In one embodiment, the tubes 62 are positioned just above the tubular portion, in the cylindrical portion, of the fiber optic feed tube 68. Other arrangements of the solvent dispersal tubes 62 may be made. Further, other types of solvent delivery systems may be substituted without departing from the spirit of this disclosure, many of which are well-known to those in the industry.

The solvent that is dispersed may be any of a number of well-known and readily available solvents used in the maintenance of oil field technologies. For example, trichloroethylene, isopropanol, or citrus-based solvents may be effective in cleaning the fiber optic cable 40 before it is returned to the spool 30.

Figure 4:
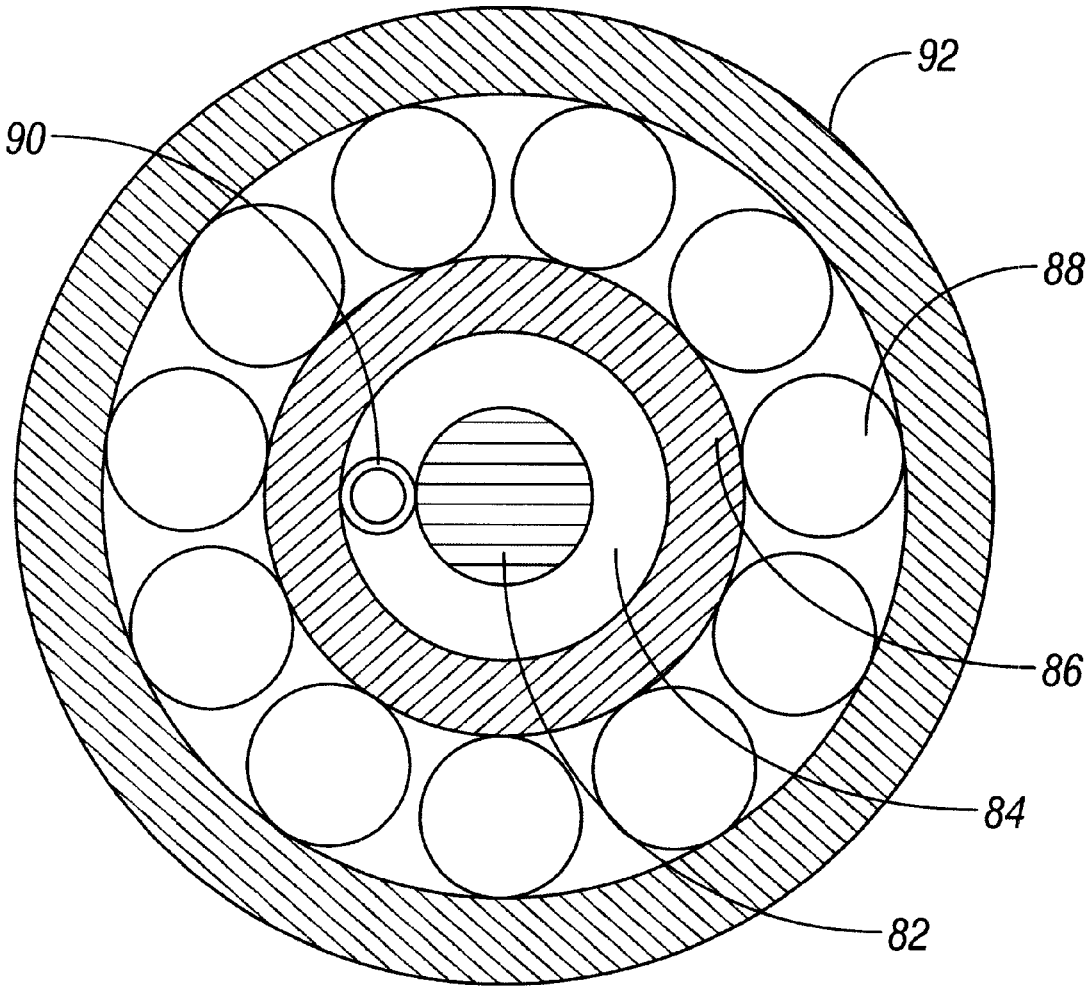
FIG. 4 is a diagram of a fiber optic cable to be disposed down a well bore according to a preferred embodiment of the invention.

The fiber optic cable 40 is depicted in FIG. 4, according to one embodiment. Central to the fiber optic cable is a bundle of fibers 82, through which light may be transported. The fibers are actually very thin strands of glass, that may be surrounded by a gel filling 84. The fiber optic cable 40 further includes tubing 86, wires 88, which are usually made of steel, and a sheath 92, giving the cable more strength.

Local data such as temperature may be measured by sending quick pulses of laser light down the fiber optic cable. A weak back-scattering of the laser light occurs, which, when measured, indicates the temperature at the point of back-scattering. In one embodiment, as the fiber optic cable 40 is disposed down the well bore, analysis of the back-scattered light spectrum is made at every meter along the fiber optic cable.

Generally, in one embodiment, pulses of light at a fixed wavelength are transmitted from the light source in surface equipment down the fiber optic line 40. At every measurement point in the line 40, light is back-scattered and returns to the surface equipment. Knowing the speed of light and the moment of arrival of the return signal, enables its point of origin along the fiber line 40 to be determined. Temperature stimulates the energy levels of the silica molecules in the fiber line 40. The back-scattered light contains upshifted and downshifted wavebands (such as the Stokes Raman and Anti-Stokes Raman portions of the back-scattered spectrum) which can be analyzed to determine the temperature at origin. In this way the temperature of each of the responding measurement points in the fiber line 40 can be calculated by the equipment, providing a complete temperature profile along the length of the fiber line 40. This general fiber optic distributed temperature system and technique is known in the prior art.

In one embodiment, part of the gel filling 84 is displaced by a gas tube 90. The gas tube allows a gas, such as nitrogen, to be transmitted through the fiber optic cable, for operating the wireline anchor 50, described in more detail, below. Although a single gas tube 90 is depicted in FIG. 4, the fiber optic cable 40 can include multiple gas tubes. With its many components and layers, the fiber optic cable is built for durability. However, in some prior art applications, the fiber optic cable may become crimped, such as when the cable is wrapped around an apparatus at an acute angle. As with a phone cord, over time, the fiber optic cable may become unwieldy in its use, as the crimping may, for example, impair the ability of the cable to be disposed down a well bore.

In some applications, therefore, the wellhead spool 100 may be preferred. The fiber optic cable 40 is unspooled from the spool and sent down the well bore in a substantially vertical direction downward. The likelihood that the fiber optic cable will become crimped is diminished, in some embodiments. Upon completion of the measurement operation, the fiber optic cable is then respooled on to the spool, where the cable is essentially stored until needed for a subsequent operation.

In prior art systems for obtaining well bore data using a sonde, the one or more instruments packed within the sonde provided some weight. Typically, the weight was sufficient such that the sonde could be disposed within the well bore using only gravity. Where the instruments were not sufficiently weighty, the sonde itself could be weighted to achieve this effect.

With fiber optic cable, however, no natural weighted element is present. Furthermore, many wells include hydrocarbons under pressure, making the insertion of fiber optic cable within problematic. Thus, according to one embodiment, a wireline anchor 50, as depicted in FIGS. 5A and 5B, may be connected to the fiber optic cable 40 before the cable is disposed down the well bore.

In one embodiment, the fiber optic cable 40, wrapped about the spool 30 of the wellhead spool 100, is extended down the fiber optic feed tube 68 and coupled to the wireline anchor 50. Accordingly, before installation, the wireline anchor 50 occupies a portion of the fiber optic feed tube 68. Then, the wireline anchor 50 is coupled to the fiber optic cable 40. Where the wireline anchor 50 is longer than the cavity (the fiber optic feed tube 68) of the wellhead spool 100, a short pipe may be inserted between the safety valve and the spool to permit the anchor to be enclosed with the fiber optic cabling prior to engagement with the Christmas tree 10.

The wireline anchor 50, therefore, is of a size sufficiently small to be disposed within the wellhead spool 100 and down the cavity of the Christmas tree 10. In one embodiment, the wireline anchor 50 is a cylindrical device composed principally of a non-corrosive metal, such as titanium. However, the anchor may be constructed of other metal, plastic, or composite materials, as the anchor typically does not stay in the well bore for an extended period of time.

Figure 5A:
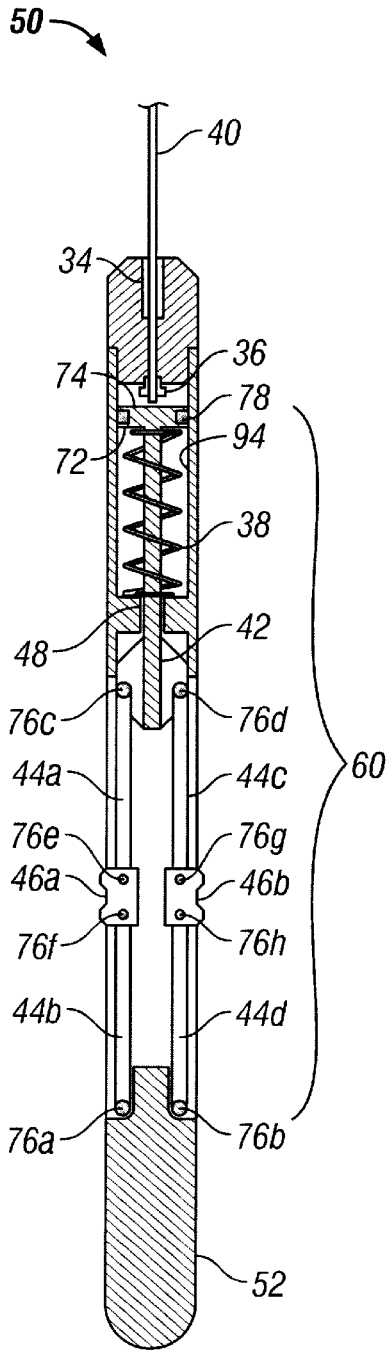
FIG. 5A is a diagram of a wireline anchor used with the wellhead spool of FIG. 1 and the fiber optic cable of FIG. 4 according to a preferred embodiment of the invention.
Figure 5B:
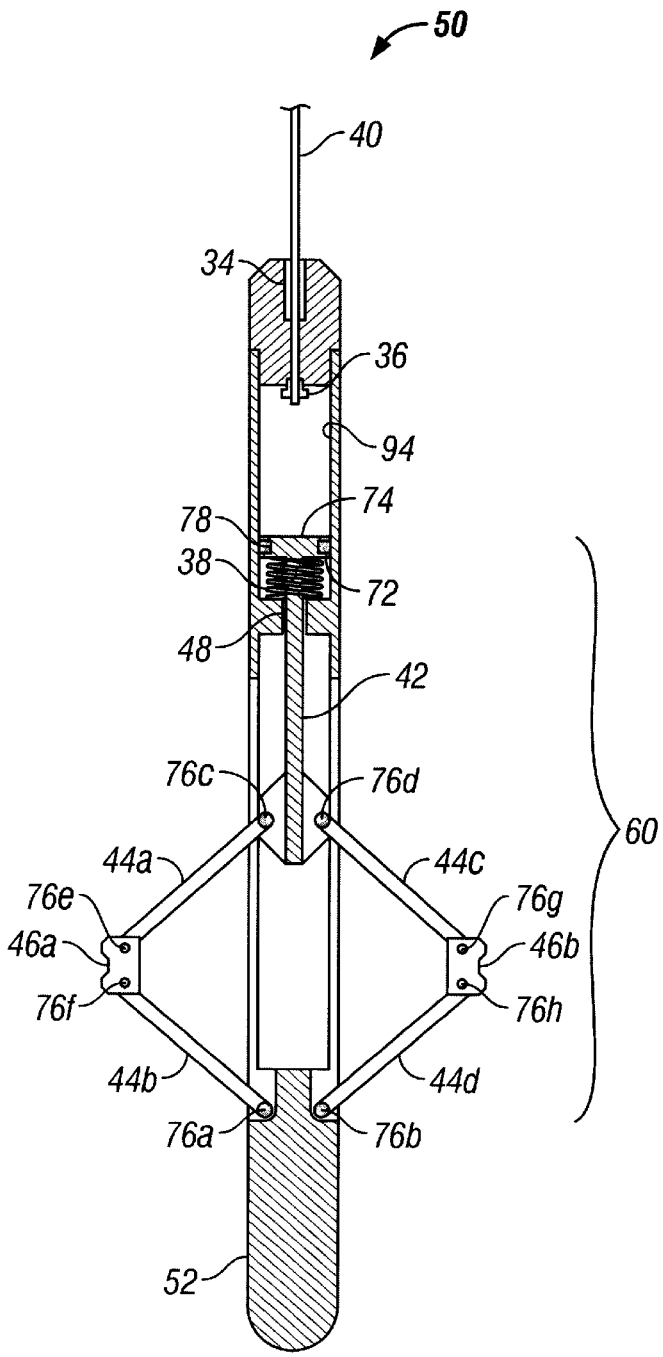
FIG. 5B is a diagram of the wireline anchor of FIG. 5A in an extended position.

In FIG. 5A, the wireline anchor 50 is shown in its retracted state. This is the state the anchor will be in as it is disposed down the well bore. In one embodiment, the wireline anchor may additionally assume an extended state, as depicted in FIG. 5B, such that the anchor may be affixed to the well wall, such as when the fiber optic cable 40 has reached the desired depth.

In one preferred embodiment, the wireline anchor 50 comprises a feed tube 34, a spring assembly 60, and a weight 52, as illustrated. The feed tube 34 receives the fiber optic cable 40. At the bottom of the feed tube is a cable connector 36. The cable connector 36 secures the fiber optic cable 40 to the wireline anchor, ensuring that the two do not separate during the trek down the well bore. The cable connector 36 may be any of a variety of securing means, such as a bolt, a clamp, or a fastener.

The spring assembly 60 comprises a spring 38, a piston 72, extension rods 44, rod housing 48, and wall engagement members, according to one embodiment. The piston 72 comprises a rod portion 42 and a head portion 74. The piston rod 42 extends through the center of the rod housing 48, parallel to the body of the wireline anchor 50. The piston head 74 is orthogonal to the piston rod 42, close to the cable connector 36.

In one embodiment, the wireline anchor 50 is cylindrical in shape. Accordingly, the piston head 74 of the anchor is a circular piece which extends a full 360 degrees along the wall of the spring assembly to allow arrangement of a dynamic sealing O-ring 78 formed in the lateral edge of the piston head. The sealing arrangement ensures that, between the cable connector 36 and the piston head 74, the cylinder bore 94 is a leak-proof cavity.

The spring 38 wraps around the piston rod 42, just below the piston head 74 and above the rod housing 48. The spring 38 is composed of a material that will allow repeated deformation and restoration of the spring 38. This allows the piston 72 to move up and down when a gas is injected into the cylinder bore 94 through the gas tube 90 (see FIG. 4) of the fiber optic cable 40.

Below the piston 72, two pairs of extension rods 44 are disposed, in parallel. A left top extension rod 44*a* is coupled to a left bottom extension rod 44*b* by a left wall engagement member 46*a* . Likewise, a right top extension rod 44*c* is coupled to a right bottom extension rod 44*d* by a right wall engagement member 46*b* , as shown.

The left and right bottom extension rods 44*b* and 44*d* are secured to a pair of hinges 76*a* and 76*b* . The hinges 76*a* and 76*b* affix the bottom of the extension rods 44*b* and 44*d* to the rod housing 48. The top of the extension rods 44*b* and 44*d* are affixed, by hinges 76*f* and 76*h*, respectively, to the wall engagement members 46.

Hinges 76*c* and 76*d* likewise affix the top of the extension rods 44*a* and 44*c* to the rod housing 48. The bottom of the extension rods 44*a* and 44*c* are affixed, by hinges 76*e* and 76*g*, respectively, to the wall engagement members 46.

The hinged connections of the extension rods 44 enable them to be mobile. When a gaseous material is injected into the wireline anchor 50 through the gas tube 90, the piston 72 moves downward until the spring 38 is maximally depressed, as shown in FIG. 5B. The extension rods 44, in turn, move such that hinges 76*c* and 76*d* move closer to hinges 76*a* and 76*b*, causing the wall engagement members 46 to move laterally. When the wireline anchor 50 is in the well bore, the gas injection causes the wall engagement members 46 to press against the wall of the well bore, according to one embodiment.

The ability to engage the wireline anchor 50 to the wall of the well bore may be useful during data gathering operations. As the wellhead spool 100 is sending the fiber optic cable 40 down the well bore, the wireline anchor 50 may be engaged with the wall of the well bore at different points. The counter 18 may be used to keep track of approximately where in the well bore the wireline anchor is disposed.

Anchor 50 can also be activated and deactivated through other means not utilizing the gas tube 90. Particularly, in an alternative embodiment, optical energy can be sent through the fibers 82 (or another light conduit) to activate anchor 50 beneath the surface. In this configuration, anchor 50 would include a photovoltaic cell that would convert the light energy to electrical energy to extend or retract anchor 50.

Additionally, in another embodiment, at least one pressure pulse (a pressure signal with a given amplitude and duration) may be sent through the wellbore fluids from the surface, and anchor 50 may include a pressure transducer that enables and commands the extension or retraction the anchor 50 only upon recognition of a given set of pulses. In another embodiment, anchor 50 may be configured to be activated by a series of rupture discs. Using such a configuration, the wellbore fluid pressure is increased at the surface, and the discs are adapted to rupture at predetermined pressures to activate or deactivate anchor 50. In this configuration, one rupture disc would preferably be designed to extend anchor 50 at one pressure and a second disc would be designed to rupture and retract anchor 50 at a second, elevated, pressure. As would be commonly understood by those skilled in the art, the rupture discs could be replaced by shear pins or the like.

Furthermore, collar stops, nipple profiles, muleshoes, or other mechanical landing devices may be disposed within the wellbore or production tubing to actuate anchor 50. These mechanical landing devices would also index fiber optic cable 40 and anchor 50 in desired measurement positions and activate anchor 50 mechanically with their profiles. Alternatively, a timer device may be disposed within anchor 50 to extend and retract anchor 50 at known time intervals. Using this system, an operator would position the anchor 50 on the fiber optic cable 40 at the desired measuring points during the pre-determined intervals.

Wellhead spool 100 may be deployed in sub-sea wells. The wellhead spool 100 may be installed upon the well head by divers or may be engaged using robotics, mechanical equipment, or using other means familiar to those of ordinary skill in the art. On-site fiber optic cable, that is, fiber optic cable that is connected to instrumentation at the well site, may be coupled to the wellhead spool, at the cable feed 58 (see FIG. 2), either prior to or following deployment below the surface of the water.

Finally, it is an aspect of the invention that the wellbore temperature profiling system and method is feasible without the use of a wellhead spool 100 as shown in FIGS. 1 and 2. An anchor may be disposed upon a fiber optic cable and raised and lowered into position within a wellbore to take temperature profile measurements in accordance with the present invention. It is also important to note that such temperature measurements can be made whether or not the particular wellbore in question is producing (hydrocarbons flowing) at the time of measurement.

While the invention has been described with respect to a limited number of embodiments; those skilled in the art will appreciate numerous modifications and variations therefrom. It is intended that the appended claims cover all such modifications and variations as fall within the true spirit and scope of the invention.

What is claimed is:

1. A wellhead spool comprising:

a connection to a wellhead;

a sealed spool for storing fiber optic cable to be disposed down a wellbore; and an anchor coupled to the fiber optic cable, wherein the anchor is placed in an opening of the well head, and the fiber optic cable is released from the spool.

2. The wellhead spool of claim 1, further comprising a motor coupled to the spool to both release the fiber optic cable from and to return the fiber optic cable to the spool.

3. The wellhead spool of claim 2, wherein the motor is hydraulically driven.

4. The wellhead spool of claim 2, further comprising a counter coupled to the motor.

5. The wellhead spool of claim 4, wherein the counter tallies a number of rotations of the spool.

6. The wellhead spool of claim 4, wherein the counter tallies a length of the fiber optic cable.

7. The wellhead spool of claim 1, further comprising a solvent dispersal tube to clean the fiber optic cable upon return to the spool.

8. The wellhead spool of claim 1, further comprising a cable feed for coupling the fiber optic cable in the spool to other fiber optic cable.

9. The wellhead spool of claim 1, wherein the fiber optic cable enters the well bore vertically.

10. The wellhead spool of claim 1, further comprising a safety valve for coupling a cavity within the wellhead spool to the well bore, wherein the cavity attains a pressure of the well bore when the safety valve is opened.

11. The wellhead spool of claim 10, further comprising a bleed valve disposed on the wellhead spool to adjust the pressure of the cavity.

12. The wellhead spool of claim 1, wherein the fiber optic cable further includes at least one gas tube for operating the anchor.

13. The wellhead spool of claim 12, wherein the anchor further comprises:

a piston coupled to a wall engagement mechanism; and a weight.

14. The wellhead spool of claim 1, wherein the anchor is remotely selectively engageable to a wall of the wellbore.

15. The wellhead spool of claim 1, wherein the wellhead is a subsea wellhead.

16. An apparatus to determine the temperature of a wellbore comprising:

a fiber optic cable to be disposed down the wellbore;

an anchor coupled to the fiber optic cable;

wherein the anchor is selectively engageable to a wall of the wellbore; and wherein the fiber optic cable is adapted to measure the temperature along the length of the cable.

17. The apparatus of claim 16 further comprising a spool to store and dispense the fiber optic cable down the wellbore.

18. The apparatus of claim 17 wherein the spool is encapsulated within a compartment that is in communication with the wellbore.

19. The apparatus of claim 16 wherein the anchor is remotely selectively expandable to engage a wall of the wellbore.

20. The apparatus of claim 18 wherein the wellhead is a sub-sea wellhead.

21. The apparatus of claim 16 wherein the anchor has a retracted position and an extended position.

22. The apparatus of claim 21 wherein the anchor engages the wellbore and resists movement when in the extended position.

23. The apparatus of claim 21 wherein optical energy in combination with a photovoltaic cell is used to actuate the anchor from the retracted position to the extended position.

24. The apparatus of claim 21 further comprising a fluid conduit extending from the wellhead to the anchor.

25. The apparatus of claim 24 wherein the anchor includes a piston, the piston connected to an extension mechanism, the extension mechanism configured to actuate the anchor from the retracted position into the extended position when the pressure of a working fluid is increased in the fluid conduit.

26. The apparatus of claim 21 wherein the anchor includes a first rupture disc, the rupture disc configured to rupture and place the anchor in the extended position when a first predetermined pressure is achieved in the wellbore.

27. The apparatus of claim 26 wherein the anchor further includes a second rupture disc, the second rupture disc configured to rupture and place the anchor in the retracted position when a second predetermined pressure is achieved in the wellbore.

28. The apparatus of claim 21 wherein the anchor is actuated from the retracted position to the extended position by a mechanical profile located within the wellbore.

29. The apparatus of claim 28 wherein the mechanical profile is selected from the group consisting of nipple profiles, collar stops, and muleshoes.

30. The apparatus of claim 21 wherein the anchor further includes a timer, said timer configured to actuate the anchor from the retracted position to the extended position at a predetermined time interval.

31. The apparatus of claim 21 wherein the anchor further includes a pressure transducer and the anchor is retracted or extended when a given pressure signal is received by the pressure transducer.

32. A method comprising:

mounting a wellhead spool in a sealable housing, the spool providing a fiber optic cable;

coupling the fiber optic cable to an anchor;

engaging the sealable housing to a wellhead of a well;

opening a valve to a wellbore of the well;

deploying the anchor and the fiber optic cable into the well bore; and coupling the fiber optic cable to a measuring instrument.

33. The method of claim 32, further comprising engaging the anchor to a wall of the well bore.

34. The method of claim 32, further comprising opening a safety valve to equalize a pressure between the sealable housing and the well bore.

35. The method of claim 34, further comprising opening a second valve to adjust the pressure in the sealable housing.

36. The method of claim 32, further comprising closing a safety valve to stop the flow of hydrocarbons to the sealable housing from the well bore.

37. The method of claim 36, further comprising opening a second valve to adjust the pressure in the sealable housing.

38. The method of claim 32, further comprising:

connecting the wellhead spool to a motor; and operating the motor to wind and unwind the wellhead spool.

39. The method of claim 38, further comprising:

returning the fiber optic cable to the wellhead spool; and removing the wellhead spool from the well head.

40. The method of claim 32, further comprising dispersing a solvent upon the fiber optic cable.

41. A method for determining the temperature of a wellbore, the method comprising:

deploying a fiber optic cable assembly into the wellbore, the fiber optic cable assembly including an anchor and a conduit for transmitting optical energy, the anchor configured to engage and disengage the wellbore to restrict or allow movement of the cable assembly therethrough;

engaging the wellbore with the anchor at a desired depth of investigation;

measuring the temperature along the length of the conduit; and disengaging the anchor from the wellbore.

42. The method of claim 41 further comprising mounting a spool to a wellhead of the wellbore.

43. The method of claim 42 further including using the spool to deploy and retract the fiber optic cable assembly to and from the wellbore.

44. The method of claim 43 further including enclosing the spool in a compartment, the compartment having an interior, the interior being in fluid communication with the wellbore.

45. The method of claim 44 further including isolating the spool, the fiber optic cable assembly, and the interior of the compartment from atmospheric conditions.

46. The method of claim 45 further including equalizing the pressure of the interior of the compartment with the pressure of the wellbore.

47. The method of claim 44 wherein the wellhead is a sub-sea wellhead.

48. The method of claim 41 further including activating the engagement of the anchor by transmitting optical energy through the conduit.

49. The method of claim 41 further including activating the engagement of the anchor by transmitting gas through a gas tube located in the fiber optic cable assembly.

50. The method of claim 41 further including activating and deactivating the engagement of the anchor by setting a timing device to engage and disengage the wellbore at specified time intervals.

51. The method of claim 41 further including activating the engagement of the anchor by transmitting a pressure signal in the wellbore that is received by a pressure transducer associated with the anchor.

52. The method of claim 41 further including activating the engagement of the anchor by elevating the pressure in the wellbore to rupture a first rupture disc associated with the anchor.

53. The method of claim 41 further including deactivating the engagement of the anchor by elevating the pressure in the wellbore to rupture a second rupture disc associated with the anchor.

54. The method of claim 41 further including activating the engagement of the anchor by engaging the anchor to a mechanical profile located within the wellbore.

55. A method to measure the temperature of a wellbore at multiple depths of investigation, the method comprising:

attaching an anchor to a fiber optic cable;

the anchor configured to engage and disengage the wellbore to restrict or allow movement of the cable therethrough;

deploying the fiber optic cable down the wellbore;

engaging the wellbore with the anchor at a desired depth of investigation;

pulsing light at a fixed wavelength from the fiber optic cable;

measuring back-scattered wavelengths of the pulsed light;

analyzing the wavelengths to determine a temperature profile at the desired depth of investigation; and disengaging the anchor from the wellbore.

* * * * *